US006673210B2

(12) United States Patent
Beck

(10) Patent No.: US 6,673,210 B2
(45) Date of Patent: Jan. 6, 2004

(54) CLEANING A SEMIPERMEABLE MEMBRANE IN A PAPERMAKING MACHINE

(75) Inventor: David A. Beck, Appleton, WI (US)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/965,435

(22) Filed: Sep. 27, 2001

(65) Prior Publication Data

US 2003/0056919 A1 Mar. 27, 2003

(51) Int. Cl.[7] ..... D21F 1/32
(52) U.S. Cl. ..... 162/199; 162/274
(58) Field of Search ..... 162/198, 199, 162/263, 272–279, 358.1, 358.2, 358.3, 358.4, 358.5, 360.2, 360.3, 361; 15/309.1; 134/15, 64 R, 122 R; 210/321.69

(56) References Cited

U.S. PATENT DOCUMENTS

| | | | | | |
|---|---|---|---|---|---|
| 1,468,057 | A | * | 9/1923 | Walker | 162/199 |
| 2,775,170 | A | * | 12/1956 | Bustin et al. | 162/199 |
| 3,956,790 | A | * | 5/1976 | Ishiwata et al. | 134/64 P |
| 3,992,301 | A | * | 11/1976 | Shippey et al. | 210/140 |
| 4,116,762 | A | * | 9/1978 | Gardiner | 134/15 |
| 4,162,936 | A | * | 7/1979 | Frezzotti | 162/276 |
| 4,437,200 | A | * | 3/1984 | Sando et al. | 100/173 |
| 5,265,537 | A | | 11/1993 | Gasparrini et al. | 101/425 |
| 5,517,714 | A | | 5/1996 | Kotitschke | 15/309.1 |
| 5,603,775 | A | * | 2/1997 | Sjoberg | 134/122 R |
| 5,783,044 | A | | 7/1998 | Schneider et al. | 162/278 |
| 5,836,044 | A | * | 11/1998 | Sinnett et al. | 15/309.1 |
| 5,900,117 | A | * | 5/1999 | Lidar | 134/122 R |
| 6,099,691 | A | * | 8/2000 | Clarke et al. | 15/302 |
| 6,136,148 | A | * | 10/2000 | Koskinen et al. | 162/199 |
| 6,280,573 | B1 | * | 8/2001 | Lindsay et al. | 162/198 |
| 6,345,453 | B1 | * | 2/2002 | Ilomaki et al. | 134/122 R |

FOREIGN PATENT DOCUMENTS

| | | | | |
|---|---|---|---|---|
| CA | 912881 | * | 10/1972 | |
| GB | 1008668 | * | 11/1965 | D21F/3/00 |

* cited by examiner

*Primary Examiner*—Steven P. Griffin
*Assistant Examiner*—Eric Hug
(74) *Attorney, Agent, or Firm*—Taylor & Aust,P.C.

(57) ABSTRACT

A method of cleaning a semipermeable membrane, the semipermeable membrane being configured for carrying a fiber web, includes the steps of providing a cleaning fluid and applying the cleaning fluid on the semipermeable membrane. Further, an air press configured for carrying the semipermeable membrane therethrough is provided, and the air press has pressurized air therein. The semipermeable membrane is conveyed through the air press and is subjected to the pressurized air within the air press. The pressurized air thereby flushes the cleaning fluid through the semipermeable membrane.

24 Claims, 2 Drawing Sheets

CLEANING A SEMIPERMEABLE MEMBRANE IN A PAPERMAKING MACHINE

STATEMENT REGARDING FEDERALLY SPONSORED RESEARCH OR DEVELOPMENT

This invention was made with Government support under Prime Contract No. DE-FC36-01GO10622 awarded by the Department of Energy. The Government has certain rights in this invention.

BACKGROUND OF THE INVENTION

1. Field of the Invention

The present invention relates to the cleaning of fabrics used in papermaking, and, more particularly, to cleaning fabrics with a low air permeability (i.e., semipermeable membranes).

2. Description of the Related Art

The need to clean fabrics of papermaking machines is well known. Since the flow of air and/or water through such fabrics is relied upon during the paper forming process, it is desirable that a maximum number of the fluid pathways available in such fabrics remain open. However, during transport of a paper web using such fabrics, various debris that is a by-product of the papermaking process can and does manage to get caught within the fluid pathways of such fabrics. This ongoing collection of debris in a fabric can reduce fluid flow rates therethrough to unacceptable levels and, if collecting near the surface of the fabric, can directly affect the surface quality of the paper being produced. Consequently, the need to effectively clean such fabrics exists.

A variety of methods and devices have already been developed for cleaning fabrics of papermaking machines. It has been disclosed to use different kinds of brushes, air jets and ultrasound spray bars. A rotatable needle jet has also been employed for cleaning fabrics. It has further been suggested to use water spray devices in combination with blowing air to clean a forming wire or screen.

However, these solutions have all been found suitable for cleaning forming wires, press belts and drying fabrics with a high air permeability. These solutions have not been found effective for cleaning low air permeability (i.e., semipermeable) fabrics. In fabrics with high air permeability, the fluid pathways tend to be both numerous and relatively large. As such, debris can be dislodged relatively easily from most such pathways, and there are enough fluid pathways available that it may not always be critical to achieve a high degree of cleanliness for the fabric to operate sufficiently.

However, in semipermeable fabrics, in order to obtain the desired low air permeability therethrough, the number of fluid pathways tend to be limited and/or relatively small, in comparison to high air permeability fabrics. Thus, removal of debris from pathways of semipermeable membranes tends to be much more difficult to achieve, and the margin for error in the number of pathways that can remain blocked and still maintain an acceptable permeability level is much smaller than it is for high air permeability fabrics.

What is needed in the art is an effective method and apparatus for cleaning semipermeable fabrics used in papermaking machines. Specifically, the method and apparatus needs to be vigorous enough to remove a high percentage of debris from a set of openings from which the removal thereof tends to be difficult.

SUMMARY OF THE INVENTION

The present invention provides a method and apparatus for cleaning a semipermeable membrane in which a cleaning fluid is applied thereto and then flushed therethrough using an air press to thereby clean the semipermeable membrane.

The invention comprises, in one form thereof, an apparatus for cleaning a semipermeable membrane, the semipermeable membrane being configured for carrying a fiber web. The apparatus includes a source of a cleaning fluid and an applicator configured for applying the cleaning fluid to the semipermeable membrane. The apparatus also includes an air press configured for carrying the semipermeable membrane therethrough. The air press having pressurized air therein is thereby configured for flushing the cleaning fluid through the semipermeable membrane.

The invention comprises, in another form thereof, a method of cleaning a semipermeable membrane, the semipermeable membrane being configured for carrying a fiber web. The method includes the steps of providing a cleaning fluid and applying the cleaning fluid on the semipermeable membrane. Further, an air press configured for carrying the semipermeable membrane therethrough is provided, and the air press has pressurized air therein. The semipermeable membrane is conveyed through the air press and is subjected to the pressurized air within the air press. The pressurized air thereby flushes the cleaning fluid through the semipermeable membrane.

An advantage of the present invention is that it provides an effective way of cleaning a semipermeable membrane having a low air permeability.

Another advantage is that it provides an effective way of cleaning a semipermeable membrane without disturbing paper quality.

Yet another advantage is that the cleaning press of the present invention can be combined with an air press used for dewatering and/or can be used for impregnating/coating the paper web.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 5:
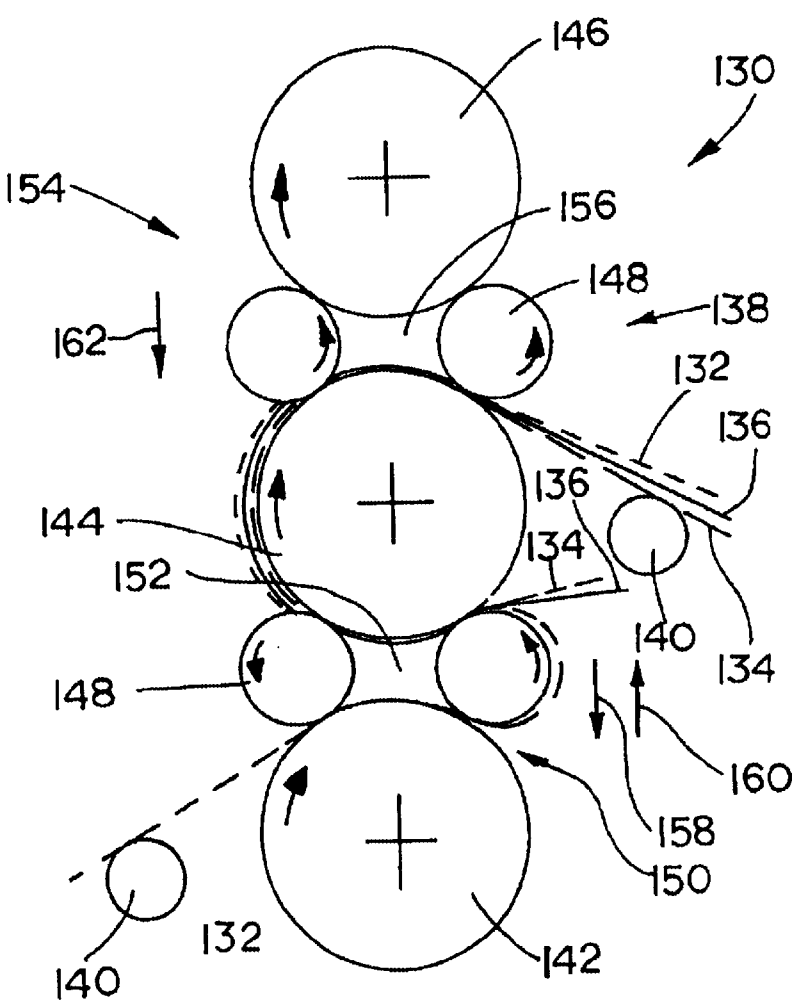
FIG. 5 is a side view of a fifth embodiment of a papermaking machine including an apparatus for cleaning a semipermeable membrane in combination with an air press used for dewatering.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF THE INVENTION

Figure 1:
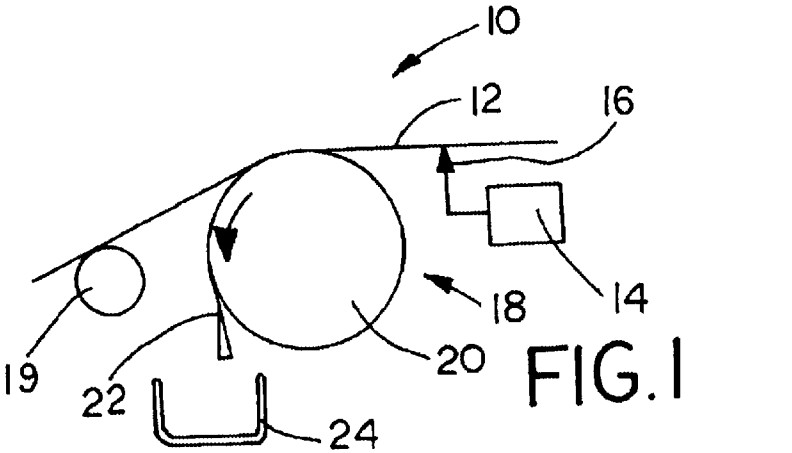
FIG. 1 is a side view of a first embodiment of a papermaking machine including an apparatus for cleaning a semipermeable membrane.

Referring now to the drawings, and more particularly to FIG. 1, there is shown a papermaking machine 10 configured for cleaning a semipermeable membrane 12 used in a papermaking process. Papermaking machine 10 generally includes a cleaning fluid source 14, a cleaning fluid applicator 16, a press 18 and at least one transfer roll 19.

The cleaning fluid provided by cleaning fluid source 14 is preferably an anionic detergent, a cationic detergent, a surfactant, a soap, a solvent and/or a solvent mixture. The cleaning fluid may include water admixed therewith.

Cleaning fluid applicator 16 is fluidly connected to cleaning fluid source 14 and is positioned adjacent to semipermeable membrane 12. Cleaning fluid applicator 16, shown schematically, is preferably a blade coater, a spray device or a transfer coater. Preferably, cleaning fluid applicator 16 is a spray device configured for applying the cleaning fluid under a high gas pressure, most preferably over a region of semipermeable membrane 12 which is greater than the space between adjacent holes therein (not shown). As such, cleaning fluid applicator 16 preferably produces a diverging spray, not a needle jet.

Press 18 is configured both for conveying and pressing semipermeable membrane 12. The pressing action provided thereby flushes the cleaning fluid through and out of semipermeable membrane 12. Press 18 includes at least one press roll 20, one of which is illustrated in FIG. 1. In this embodiment, press roll 20 has positioned thereagainst a doctor blade 22 for removing debris and used cleaning fluid after pressing and cleaning occurs. A trough 26 is positioned below doctor blade 22 for collecting the removed debris and used cleaning fluid.

Figure 2:
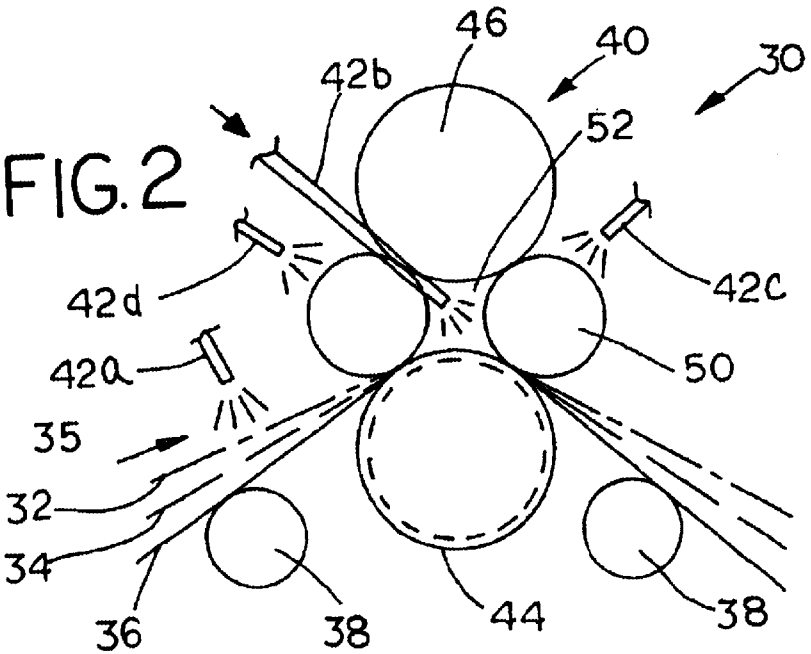
FIG. 2 is a side view of a second embodiment of a papermaking machine including an apparatus for cleaning a semipermeable membrane.

A second embodiment of the invention, as shown in FIG. 2, discloses a papermaking machine 30 which is capable of both cleaning semipermeable membrane 32 and pressing paper web 34. Papermaking machine 30, in addition to semipermeable membrane 32, includes a permeable layer 36, a plurality of conveyor rolls 38, air press 40 and at least one of cleaning fluid sprayers 42*a*–42*d*. Papermaking machine 30 may be used solely for cleaning semipermeable membrane 32 or may be used for pressing, coating and/or impregnating paper web 34, in addition to cleaning of semipermeable membrane 32 and permeable layer 36.

Semipermeable membrane 32 and permeable membrane 36 are provided for carrying paper web 34. Semipermeable membrane 32 has a low air permeability specially designed for displacement dewatering. Permeable membrane 36 has a high air permeability and may be a felt, a wire, a press belt, drying fabric or an anti-rewet layer.

Air press 40 includes a first main roll 44, a second main roll 46, a first cap roll 48 and a second cap roll 50, which conjunctively define a pressurized air chamber 52. The pressure of the air in pressurized air chamber 52 serves to flush the cleaning fluid through semipermeable membrane 32. The pressure of the air therein is greater than atmospheric pressure (about 1 bar), advantageously more than about 2 bar and preferably greater than approximately 5 bar. First main roll 44 is vented (e.g., blind-drilled, grooved, etc.) so as to promote removal of water, used cleaning fluid and debris from semipermeable membrane 32.

At least one of cleaning fluid sprayers 42*a*–42*d* is provided as part of papermaking machine 30. Cleaning fluid sprayer 42*a* is directed toward semipermeable membrane 32 from a position just upstream of air press 40, relative to web travel direction 35. Cleaning fluid sprayer 42*b* extends into pressurized air chamber 52 and is configured to deliver cleaning fluid onto semipermeable membrane 32 from within pressurized air chamber 52. Cleaning fluid sprayer 42*c* is located adjacent to second cap roll 50. Cleaning fluid sprayer 42*c* and second cap roll 50 together are configured to act as a transfer coater for indirectly delivering cleaning fluid onto semipermeable membrane 32. Similarly, cleaning fluid sprayer 42*d* and first cap roll 48 together also function as a transfer coater.

Figure 3:
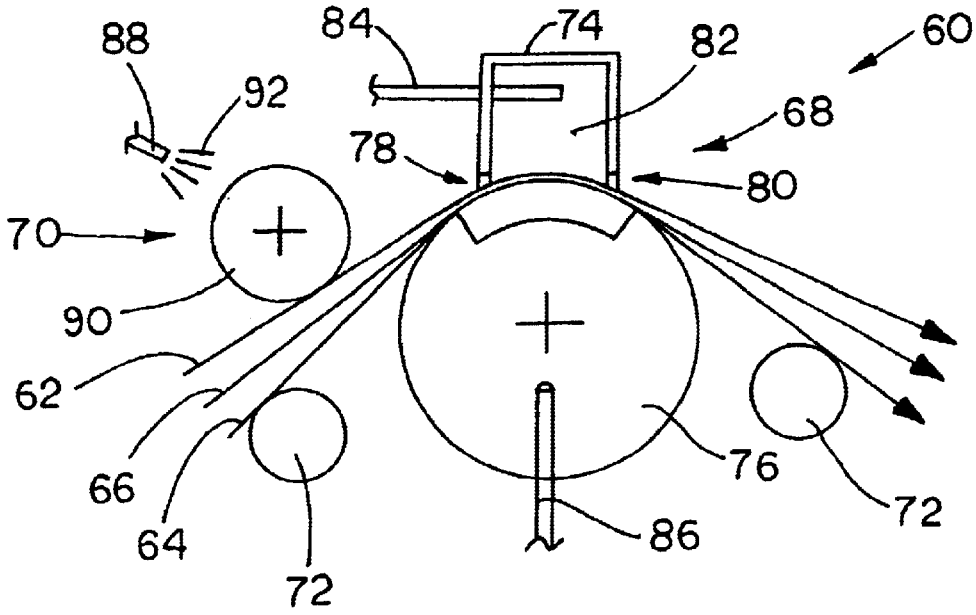
FIG. 3 is a side view of a third embodiment of a papermaking machine including an apparatus for cleaning a semipermeable membrane.

In yet another embodiment, papermaking machine 60 (FIG. 3) includes a semipermeable membrane 62 and a permeable membrane 64 for carrying a paper web 66, an air press 68, a cleaning fluid applicator 70 and conveyor rolls 72.

Air press 68 includes a box arrangement 74 mounted adjacent a suction roll 76. Box arrangement 74 and suction roll 76 coact to form an entrance nip 78 and an exit nip 80 therebetween, respectively through which semipermeable membrane 62, permeable membrane 64 and paper web 66 are fed into and out of air press 68. Box arrangement 74 and suction roll 76 together define an air pressure chamber 82. Box arrangement 74 has an air inlet line 84 associated therewith for introducing air under pressure into air pressure chamber 82. Conversely, suction roll 76 is provided with a vacuum line 86 for creating a negative pressure therein.

Cleaning fluid applicator 70 is positioned prior to entrance nip 78, relative to a web travel direction 87, and adjacent semipermeable membrane 62. Cleaning fluid applicator 70 includes a sprayer 88 and an applicator roll 90. Sprayer 88 delivers cleaning fluid 92 onto applicator roll 90 which, in turn, transfers cleaning fluid 92 to semipermeable membrane 62. Alternatively or additionally to cleaning fluid applicator 70, a cleaning fluid dispenser (not shown) could be provided within air pressure chamber 122, in a manner similar to cleaning fluid sprayer 42*b* in FIG. 2.

Figure 4:
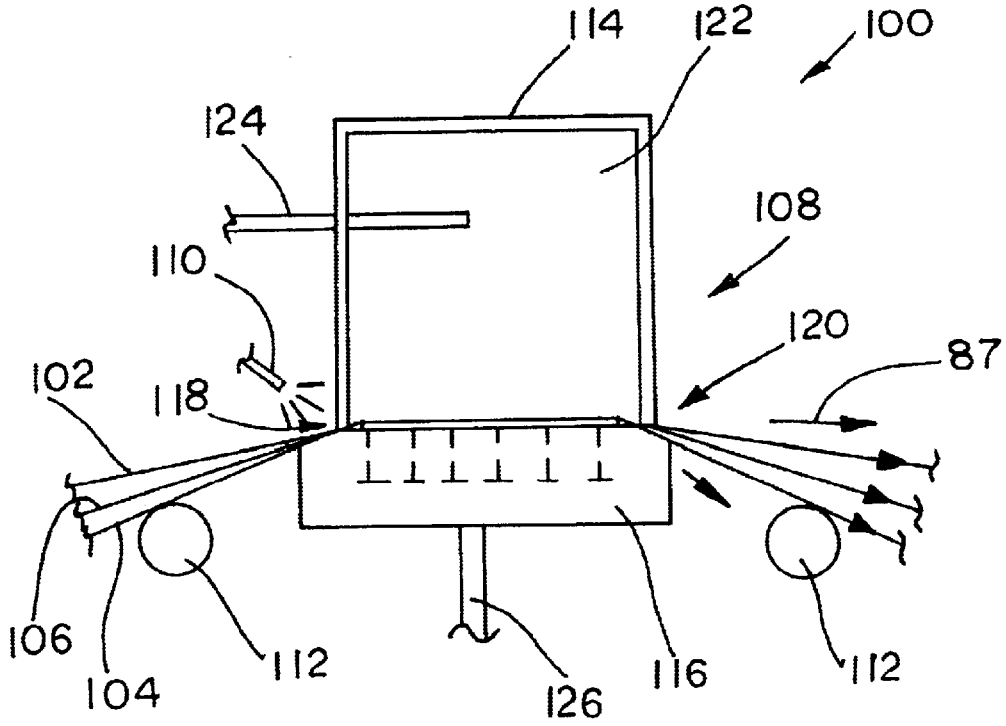
FIG. 4 is a side view of a fourth embodiment of a papermaking machine including an apparatus for cleaning a semipermeable membrane.

A further embodiment of the invention is shown in FIG. 4. Specifically, papermaking machine 100 includes a semipermeable membrane 102 and a permeable membrane 104 for carrying a paper web 106, an air press 108, a cleaning fluid sprayer 110 and conveyor rolls 112.

Air press 108 includes a box arrangement 114 mounted adjacent a press shoe 116. Box arrangement 114 and press shoe 116 coact to form an entrance nip 118 and an exit nip 120 therebetween, respectively through which semipermeable membrane 102, permeable membrane 104 and paper web 106 are fed into and out of air press 108. Box arrangement 114 and press shoe 116 together define an air pressure chamber 122. Box arrangement 114 has an air inlet line 124 associated therewith for introducing air under pressure into air pressure chamber 122. Conversely, press shoe 116 is provided with a vacuum line 126 for creating a negative pressure therein. Additionally or alternatively to cleaning fluid sprayer 110, a cleaning fluid dispenser (not shown) could be provided within air pressure chamber 122 in a manner similar to cleaning fluid sprayer 42*b* in FIG. 2.

A yet another embodiment is set forth in FIG. 5. Papermaking machine 130 includes a semipermeable membrane 132 and a permeable membrane 134 for carrying a paper web 136, a two-stage air press 138 and conveyor rolls 140.

Two-stage air press 138 is a cluster press that includes a first main roll 142, a second main roll 144, a third main roll 146 and four cap rolls 148. Preferably, first main roll 142 and second main roll 144 are vented in order to promote removal of water, used cleaning fluid (initially applied in a manner shown in FIGS. 1–4) and/or debris. Stage one 150 of two-stage air press 138 is defined by first main roll 142, second main roll 144 and a pair of cap rolls 148. Stage one 150 has a first air chamber 152 associated therewith. In the embodiment illustrated, semipermeable membrane 132 is fed into first air chamber 152 adjacent first main roll 142 to maximize the time spent thereby in first air chamber 152. Conversely, permeable membrane 134 and paper web 136 are fed in later, adjacent to second main roll 144.

Stage two 154 is defined by second main roll 144, third main roll 146 and a pair of cap rolls 148. Stage two 154 has a second air chamber 156 associated therewith. In two-stage air press 138, first air chamber 152 is for cleaning, and second air chamber 156 is for dewatering.

Stage one 150 has at least one of a first flushing direction 158 and a second flushing direction 160 associated therewith, and stage two 154 has an associated dewatering direction 162. First flushing direction 158 and second flushing direction 160 are directed at first main roll 142 and second main roll 144, respectively, within first air chamber 152. Dewatering direction 162 extends toward second main roll 144 from inside second air chamber 156. First flushing direction 158 is substantially the same as dewatering direction 162 (relative to the orientation of papermaking machine 130) but is substantially diametrical to second flushing direction 160. Each direction 158, 160 and 162 signifies movement of fluid from a high pressure chamber side toward one of vented main rolls 142 and 144. Stage one 150 may be chosen to be operated in first flushing direction 158 and/or second flushing direction 160 in order to achieve high cleanliness, especially if there are stickies in the pulp.

In cleaning semipermeable membrane 32, a cleaning fluid is provided and is applied on semipermeable membrane 32. Air press 40 is provided and has pressurized air therein. Semipermeable membrane 32 is conveyed into air press 40 and is subjected to the pressurized air therein. The pressurized air flushes the cleaning fluid through semipermeable membrane 32, thereby cleaning semipermeable membrane 32.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of cleaning a semipermeable membrane, said semipermeable membrane being configured for carrying a fiber web, said method comprising the steps of:

providing a cleaning fluid;

applying said cleaning fluid on said semipermeable membrane;

providing an air press, said air press being configured for carrying said semipermeable membrane therethrough and removing water from said fiber web, said air press having pressurized air therein;

conveying said semipermeable membrane through said air press; and subjecting said semipermeable membrane to said pressurized air within said air press, said pressurized air thereby flushing said cleaning fluid through said semipermeable membrane.

2. The method of claim 1, wherein said cleaning fluid is comprised of at least one of an anionic detergent, a cationic detergent, a surfactant, a soap, a solvent and a solvent mixture.

3. The method of claim 2, wherein said cleaning fluid further includes water.

4. The method of claim 1, wherein said cleaning fluid is applied at least one of inside and outside of said air press.

5. The method of claim 1, wherein said applying step includes at least one of blade-coating said cleaning fluid on said semipermeable membrane; spraying said cleaning fluid on said semipermeable membrane; and applying said cleaning fluid on a roll and transferring said cleaning fluid from said roll onto said semipermeable membrane.

6. The method of claim 5, wherein said applying step includes spraying said cleaning fluid in a manner so as to form a divergent spray thereof.

7. The method of claim 1, wherein said air press is one of a multiple-roll cluster arrangement and a box arrangement, each of said multiple-roll cluster arrangement and said box arrangement defining a pressurized chamber, said pressurized chamber having said pressurized air therein.

8. The method of claim 1, wherein a flushing pressure of said pressurized air on said semipermeable membrane is greater than approximately atmospheric pressure.

9. The method of claim 8, wherein said flushing pressure is greater than approximately 2 bar.

10. The method of claim 9, wherein said flushing pressure is greater than approximately 5 bar.

11. The method of claim 1, wherein said air press is a cleaning press used for cleaning said semipermeable.

12. A method of cleaning a semipermeable membrane, said semipermeable membrane being configured for carrying a fiber web, said method comprising the steps of:

providing a cleaning fluid;

applying said cleaning fluid on said semipermeable membrane;

providing an air press, said air press being configured for carrying said semipermeable membrane therethrough, said air press having pressurized air therein;

conveying said semipermeable membrane through said air press; and subjecting said semipermeable membrane to said pressurized air within said air press, said pressurized air thereby flushing said cleaning fluid through said semipermeable membrane;

wherein said air press includes a plurality of rolls, one of said rolls being a cap roll, said applying step including the substep of:

applying said cleaning fluid on said cap roll; and transferring said cleaning fluid from said cap roll onto said semipermeable membrane.

13. A method of cleaning a semipermeable membrane, said semipermeable membrane being configured for carrying a fiber web, said method comprising the steps of:

providing a cleaning fluid;

applying said cleaning fluid on said semipermeable membrane;

providing an air press, said air press being configured for carrying said semipermeable membrane therethrough, said air press having pressurized air therein;

conveying said semipermeable membrane through said air press; and subjecting said semipermeable membrane to said pressurized air within said air press, said pressurized air thereby flushing said cleaning fluid through said semipermeable membrane;

wherein said air press is a cleaning press used for cleaning said semipermeable membrane; and said cleaning press is further configured for at least one of impregnating and coating the fiber web carried by said semipermeable membrane.

14. A method of cleaning a semipermeable membrane, said semipermeable membrane being configured for carrying a fiber web, said method comprising the steps of:

providing a cleaning fluid;

applying said cleaning fluid on said semipermeable membrane;

providing an air press, said air press being configured for carrying said semipermeable membrane therethrough, said air press having pressurized air therein;

conveying said semipermeable membrane through said air press; and subjecting said semipermeable membrane to said pressurized air within said air press, said pressurized air thereby flushing said cleaning fluid through said semipermeable membrane;

said air press is a cleaning press used for cleaning said semipermeable membrane; and further comprising the steps of:

providing a second air press, said semipermeable membrane having a membrane direction of travel, said second air press being located after said cleaning press in said membrane direction of travel;

carrying said semipermeable membrane through said second air press; and dewatering said semipermeable membrane within said second air press.

15. The method of claim 14, wherein said cleaning press and said second air press conjunctively from a two-chamber cluster arrangement.

16. The method of claim 14, wherein each of said first air press and said second air press have at least one vented member associated therewith, said pressurized air in said cleaning press forcing cleaning fluid toward one said at least one vented member associated therewith, said pressurized air in said second air press forcing water toward one said at least one vented member associated therewith.

17. An apparatus for cleaning a semipermeable membrane, said semipermeable membrane being configured for carrying a fiber web, said apparatus comprising:

a source of a cleaning fluid;

an applicator configured for applying said cleaning fluid to said semipermeable membrane; and an air press configured for carrying said semipermeable membrane therethrough, said air press having pressurized air therein, said air press thereby being configured for flushing said cleaning fluid through said semipermeable membrane.

18. The apparatus of claim 17, wherein said cleaning fluid is comprised of at least one of an anionic detergent, a cationic detergent, a surfactant, a soap, a solvent and a solvent mixture.

19. The apparatus of claim 17, wherein said applicator is one of a blade coater, a spray device, and a transfer coater.

20. The apparatus of claim 17, wherein said air press is one of a multiple-roll cluster arrangement and a box arrangement, each of said multiple-roll cluster arrangement and said box arrangement defining a pressurized chamber, said pressurized chamber having said pressurized air therein.

21. An apparatus for cleaning a semipermeable membrane, said semipermeable membrane being configured for carrying a fiber web, said apparatus comprising:

a source of a cleaning fluid;

an applicator configured for applying said cleaning fluid to said semipermeable membrane; and an air press configured for carrying said semipermeable membrane therethrough, said air press having pressurized air therein, said air press thereby being configured for flushing said cleaning fluid through said semipermeable membrane;

wherein said applicator is one of a blade coater, a spray device and a transfer coater and said air press includes a plurality of rolls, one of said rolls being a cap roll, said applicator being said transfer coater, said cap roll functioning as a transfer roll of said transfer coater.

22. An apparatus for cleaning a semipermeable membrane, said semipermeable membrane being configured for carrying a fiber web, said apparatus comprising:

a source of a cleaning fluid;

an applicator configured for applying said cleaning fluid to said semipermeable membrane; and an air press configured for carrying said semipermeable membrane therethrough, said air press having pressurized air therein, said air press thereby being configured for flushing said cleaning fluid through said semipermeable membrane;

wherein said air press is a cleaning press used for cleaning the semipermeable membrane, said apparatus further comprising a second air press, the semipermeable membrane having a membrane direction of travel, said second air press being located after said cleaning press in the membrane direction of travel.

23. A papermaking machine, comprising:

a semipermeable membrane, said semipermeable membrane being configured for carrying a fiber web;

a plurality of conveyor rolls, each conveyor roll configured for carrying at least one of said semipermeable membrane and said fiber web;

a source of a cleaning fluid;

an applicator configured for applying said cleaning fluid to said semipermeable membrane; and a press configured for pressing said semipermeable membrane and for thereby flushing said cleaning fluid therethrough.

24. A papermaking machine, said machine comprising:

a semipermeable membrane, said semipermeable membrane being configured for carrying a fiber web;

a plurality of conveyor roll, each conveyor roll configured for carrying at least one of said semipermeable membrane and said fiber web;

a source of a cleaning fluid;

an applicator configured for applying said cleaning fluid to said semipermeable membrane; and an air press configured for carrying said semipermeable membrane therethrough, said air press having pressurized air therein, said air press thereby being configured for flushing said cleaning fluid through said semipermeable membrane.

* * * * *